US006720727B1

(12) United States Patent
Lee et al.

(10) Patent No.: US 6,720,727 B1
(45) Date of Patent: Apr. 13, 2004

(54) CATHODE RAY TUBE HAVING DEFLECTION POWER REDUCING SHAPE

(75) Inventors: Bong-Woo Lee, Suwon (KR); Do-Nyun Kim, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 337 days.

(21) Appl. No.: 09/599,057

(22) Filed: Jun. 21, 2000

(30) Foreign Application Priority Data

Jun. 25, 1999 (KR) ..... 99-24354
Jul. 5, 1999 (KR) ..... 99-26918

(51) Int. Cl.[7] ..... H01J 33/00
(52) U.S. Cl. ..... 313/477 R; 220/2.1 A
(58) Field of Search ..... 220/2.1 R, 2.1 A, 220/2.3 A; 313/477 R, 440, 477 NC, 318.05

(56) References Cited

U.S. PATENT DOCUMENTS 5,763,995 A * 6/1998 Sano et al. ..... 313/477 R
6,002,203 A * 12/1999 Yokota et al. ..... 313/477 R
6,188,173 B1 2/2001 Kang et al.
6,268,692 B1 * 7/2001 Yokota et al. ..... 313/477 R
6,353,284 B1 * 3/2002 Elfner et al. ..... 313/477 R
6,384,525 B1 * 5/2002 Sano et al. ..... 313/440

* cited by examiner

*Primary Examiner*—Nimeshkumar D. Patel
*Assistant Examiner*—Karabi Guharay
(74) *Attorney, Agent, or Firm*—Christie, Parker & Hale, LLP

(57) ABSTRACT

A cathode ray tube for reducing a deflection power without any BSN problem is disclosed. The cathode ray tube has a panel, a funnel having a deflection yoke on an outer periphery thereof, and a neck connected to the cone of the funnel. A phosphor screen is arranged on an inner surface of the panel. The funnel includes a body connected to the panel, and a cone connected to the body. The cone has a deflection power reducing shape which is formed to have a range of length 0.25×L from an end of the cone at the neck where L is an entire length of the cone measured along an axis of symmetry of the cathode ray tube.

3 Claims, 2 Drawing Sheets

CATHODE RAY TUBE HAVING DEFLECTION POWER REDUCING SHAPE

BACKGROUND OF THE INVENTION (a) Field of the Invention

The present invention relates to a cathode ray tube, more particularly, to a cathode ray tube having an improved funnel, on which the deflection yoke is mounted, capable of decreasing deflection power.

(b) Description of the Related Art

In a well-known cathode ray tube, electron beams emitted from an electron gun assembly are deflected to a phosphor screen in a horizontal and vertical direction. The electron beams impinge on a corresponding phosphor pixel, resulting in emission of light to form images or characters.

Cathode ray tubes are mainly installed in color televisions or computer monitors to be provided to consumers. Recently, cathode ray tubes have been enhanced to be installed in High-Definition televisions (HDTV).

In order to cope with OA equipment, e.g., an HDTV or monitor for a PC, either the deflection frequency must be increased, or the anode voltage for finally accelerating the electron beams must be increased. An increase in anode voltage and an increase in deflection frequency cause an increase in deflection power, i.e., an increase in consumption power of the deflection yoke.

In order to solve these problems, the neck diameter of conventional cathode ray tubes has been decreased, and the deflection magnetic field generated from the deflection yoke is likely to approach the trajectories of the electron beams so that the deflection power efficiency can be improved.

However, since the neck diameter is decreased, it is difficult to manufacture the cathode ray tube, and the focus characteristics of the electron gun assembly are deteriorated.

Therefore, in another conventional cathode ray tube, the neck diameter is maintained (about $\phi$29.1 mm), but the outer diameter of the funnel near the neck side is decreased, so that the deflection power is reduced. However, when an electron beam is deflected in a direction along the maximum size of the screen, i.e., along the diagonal direction, the electron beam passes close to the inner surface of the funnel near the neck side on which the deflection yoke is mounted. This situation is called a BSN (Beam Strikes the Neck) problem. For this reason, the resultant image is not properly formed.

In this cathode ray tube, since the neck diameter is simply decreased through the experience of a designer or trial and error, it is difficult to effectively solve the BSN problem. Accordingly, it is difficult to decrease the deflection power.

SUMMARY OF THE INVENTION

In view of the prior art described above, it is an object of the present invention to provide a cathode ray tube capable of reducing the deflection power while preventing a BSN problem.

To achieve this object, as embodied and broadly described herein, the invention comprises

- a panel, a phosphor screen being arranged on an inner surface of the panel;
- a funnel having a deflection yoke on an outer periphery thereof, including:
  - a body connected to the panel; and
  - a cone connected to the body; and
- a neck, connected to the cone of the funnel, having an electron gun disposed therein. The cone has a deflection power reducing shape which is formed to have a range of length 0.25×L from an end of the cone at the neck where L is an entire length of the cone measured along an axis of symmetry of the cathode ray tube.

According to an aspect of the present invention, the deflection power reducing means is formed in such a manner that the outline of the cone has a shape of an arc on a range of the length 0.25×L from the end of the cone at the neck as viewed in a cross section perpendicular to the axis of symmetry and satisfies the following conditions:

$$|Cz|<4.5 \text{ mm}$$

$$25 \text{ mm}<r1<50 \text{ mm}$$

where Cz is a coordinate of a center of the aforementioned arc; and r1 is a radius of curvature of the arc.

According to another aspect of the present invention, the deflection power reducing means is formed in such manner that the outline of the cone has a curvature on a range of the length 0.25×L from the end of the cone at the neck as viewed in a cross section perpendicular to the axis of symmetry and satisfies the following conditions:

$$0.26<R<0.43$$

where R is an average variation of height measured from the axis of symmetry to the each point of the curvature.

Both foregoing general description and the following Detailed Description are exemplary and are intended to provide further explanation of the invention as claimed.

BRIEF DESCRIPTION OF THE DRAWINGS

The accompanying drawings provide a further understanding of the invention and, together with the Detailed Description, explain the principles of the invention. In the drawings.

DETAILED DESCRIPTION OF THE PREFERRED EMBODIMENTS

The present invention will be described in detail with reference to the accompanying drawings.

Figure 1:
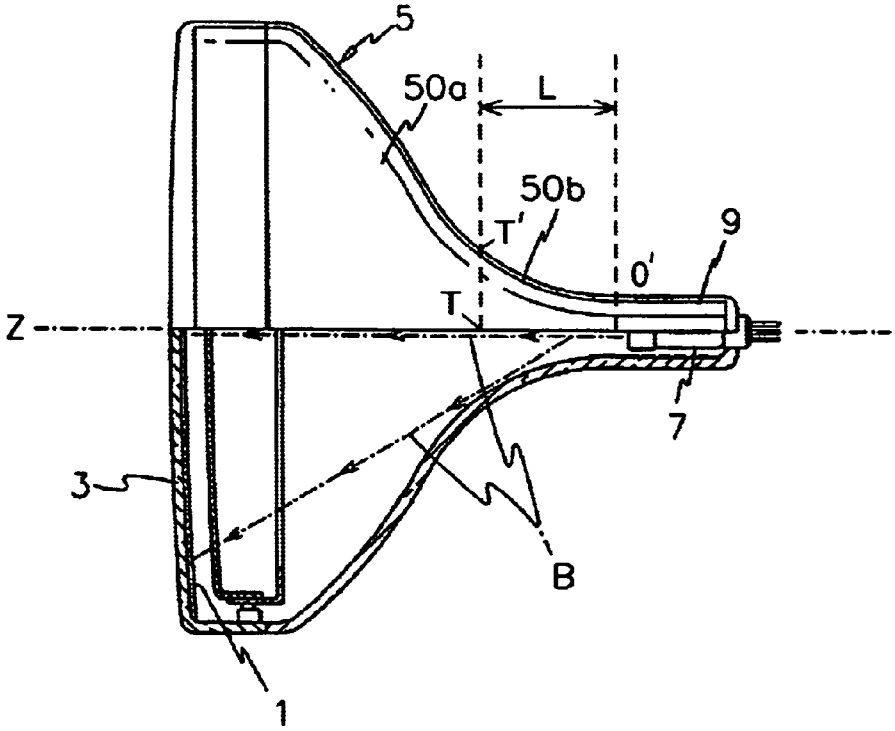
FIG. 1 shows a cross section of a cathode ray tube, as viewed in a cross section perpendicular to the axis of symmetry, according to a first preferred embodiment of the present invention.

Referring to FIG. 1, a cathode ray tube is formed with a vacuum envelope having a substantially rectangular panel 3, a funnel 5 formed contiguous to the panel 3, and a cylindrical neck 9 formed contiguous to the funnel 5. A phosphor screen 1 is formed on the inner surface of the panel 3. A deflection yoke (not shown) is mounted on the outer side of the funnel 5 near the neck 9.

Electron beams 8 emitted from the electron gun 7 scan the phosphor screen 1. In order to effectively deflect the electron beams, the funnel 5 is shaped as follows:

First, the funnel 5 has a body 50*a* formed contiguous to a seal surface of the panel 3, and a cone 50*b* formed between the body 50*a* (at point T') and the neck 9 (at point O') as shown in FIG. 1. Point O' is the end of the neck 9, at which the curved cone starts, as shown in FIG. 1. As shown, point T' is the inflection point formed where the concaved cone part 50*b* connects to the convexed body 50*a*.

The inventors of the present invention improve the shape of the cone 50*b*. According to a first embodiment of the present invention, reference Z indicates an axis of symmetry of the cathode ray tube, while reference O indicates an origin which is an end of the cone 50*b* next to the neck 9 on the Z axis. Reference L is an entire length of the cone 50*b* between the body 50*a* (at point T) and the neck 9 (at point O), which is measured on the axis of symmetry Z.

In order to form the funnel 5, the cone 50*b* is formed in such a manner that the outer periphery of the cone 50*b* has a predetermined curvature which is contiguous to the body 50*a*, as viewed in a cross section perpendicular to the Z axis. Specifically, the outline of the cone 50*b* has a shape of an arc A on a range from the origin 0 to a position 25% of the entire length L (the length 0.25×L) from the origin as viewed in a cross section perpendicular to the Z axis.

The center (Cz, Cy) and the radius of curvature r1 of the arc A are set to satisfy the following conditions:

$$|Cz|<4.5 \text{ mm}$$

$$25 \text{ mm}<r1<50 \text{ mm}.$$

If the absolute value of the center coordinate Cz exceeds 4.5 mm, the curvature of the arc A in the cone 50*b* changes abruptly, resulting in strength risk of the cathode ray tube. Further, the deflection efficiency is reduced if the radius of curvature r1 is larger than 50 mm, while the BSN of electron beams deteriorates if the radius of curvature r1 is smaller than 25 mm.

The above parameters Cz and r1 are preferably set to 2.81 mm and 28.95 mm respectively, according to the first embodiment of the present invention. Another center coordinate Cy is preferably set to 43.39 mm. The parameter Cz is positive when the center is located toward the neck 9 from the origin O, while the parameter Cz is negative when the center is located toward the cone 50*b* from the origin O.

Figure 2:
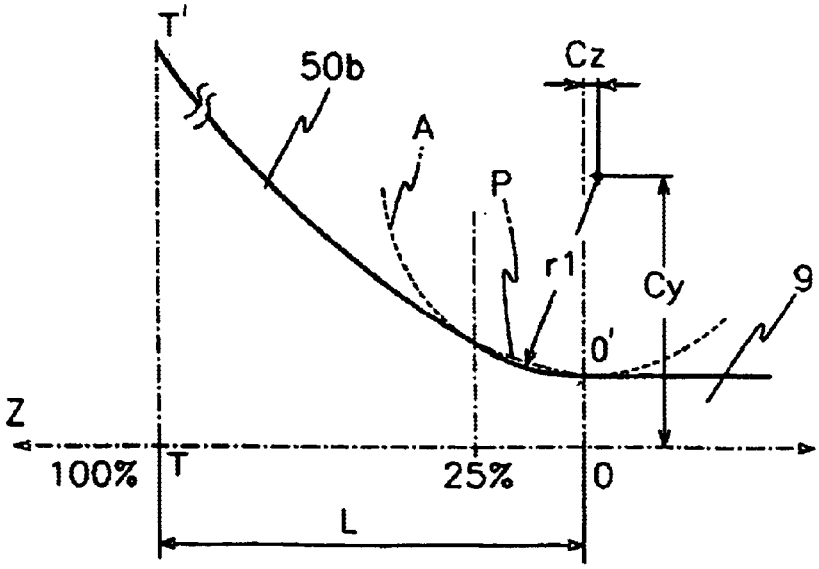
FIG. 2 illustrates a cone of a funnel according to the first preferred embodiment of the present invention.

The cone of the funnel which satisfies the above conditions has a smaller diameter than that of a prior art funnel at a dashed line P in FIG. 2. The inventors of the present invention have noted through a plurality of computer simulations that the deflection yoke mounted on the cone according to the present invention effectively deflects electron beams without any BSN problems.

The inventors have also noted that the magnetic deflection field (specifically a horizontal field) which is generated by the deflection yoke mounted on the cone according to the present invention approaches the trajectories of the electron beams, thereby reducing deflection power. According to the first preferred embodiment, the deflection power is decreased by 9.76% with respect to the prior art for a 17-inch cathode ray tube (deflection angle: 90°). Table 1 shows parameters of the above conditions for a 17-inch cathode ray tube according to the present invention and prior art.

TABLE 1

| | Cz (mm) | Cy (mm) | R1 (mm) | Deflection power |
|---|---|---|---|---|
| Present invention | 2.81 | 43.39 | 28.95 | 90.24% |
| Prior art | 4.99 | 105.86 | 91.45 | 100% |

Figure 3:
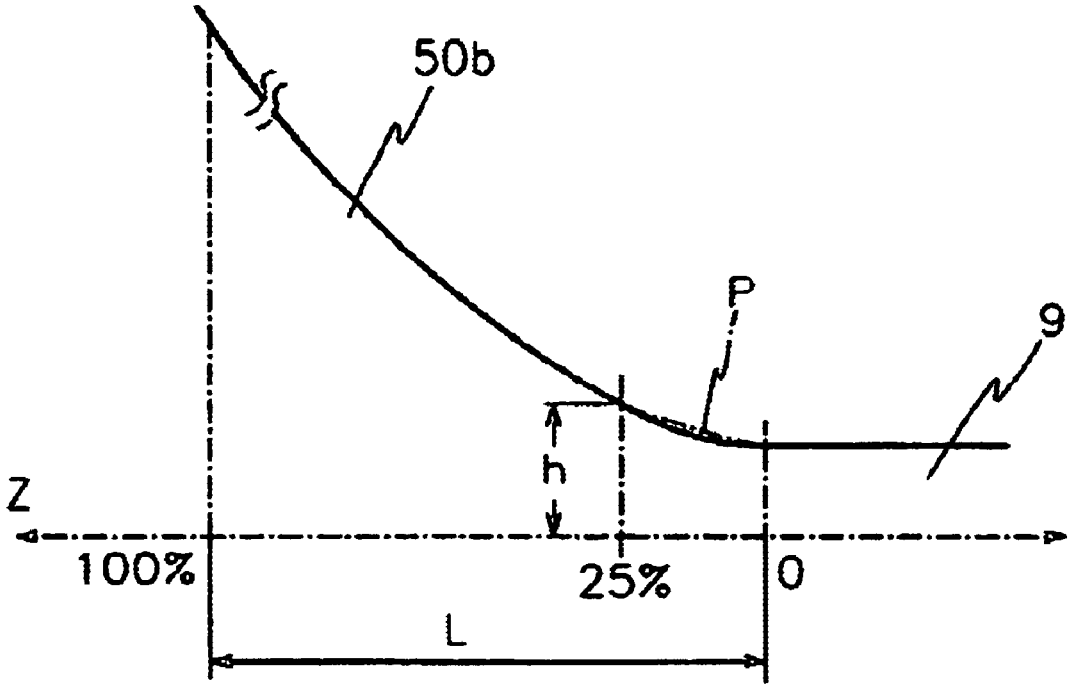
FIG. 3 illustrates a cone of a funnel according to a second preferred embodiment of the present invention.

A second preferred embodiment of the present invention will now be described with reference to FIG. 3. The cathode ray tube according to the second preferred embodiment has similar structures to the first preferred embodiment, and further descriptions thereof will not be made. Referring to FIG. 3, the cone 50*b* is formed in such a manner that the outline of the outer periphery of the cone 50*b* has a curvature which is contiguous to the body 50*a*, as viewed in a cross section perpendicular to the Z axis. Specifically, the outline of the cone 50*b* has a predetermined average variation of height h on a range of the Z axis to a position 25% of the entire length L (the length 0.25×L) from the origin 0 as viewed in a cross section perpendicular to the Z axis. The height h is measured from the Z-axis to the outer periphery of the cone 50*b*. The average variation of the height h is set to satisfy the following condition:

$$0.26<R<0.43$$

where R is average variation of height h ($R=\Delta h/\Delta z|_{average}$).

The BSN of electron beams deteriorates if the average variation R is higher than 0.43, while the deflection efficiency is reduced if the average variation R is lower than 0.26.

The above parameter R is preferably set to 0.26 according to the second embodiment of the present invention. The cone of the funnel which satisfies the above condition has a smaller diameter than that of a prior art at a dashed line P in FIG. 3. The inventors of the present invention have noted through computer simulations that the deflection yoke mounted on the cone according to the present invention deflects electron beams without BSN problems.

The inventors also have noted that the magnetic field (specifically the horizontal field) which is generated by the deflection yoke mounted on the cone according to the present invention approaches the trajectories of the electron beams, thereby reducing deflection power. According to the first preferred embodiment, the deflection power is decreased by 9.76% with respect to the prior art for a 17-inch cathode ray tube (deflection angle: 90°). Table 2 shows parameters of the above conditions for a 17-inch cathode ray tube according to the present invention and prior art.

TABLE 2

| | R | Deflection power |
|---|---|---|
| Present invention | 0.41 | 90.24% |
| Prior art | 0.18 | 100% |

An inner shape of the funnel 5 comprising the cone 50*b* is preferably formed with a similar curvature to the outer shape of the funnel. A thickness of the funnel is preferably determined by considering the BSN of the electron beam and atmospheric pressure tolerance.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A cathode ray tube comprising:

a panel, a phosphor screen being arranged on an inner surface of the panel;

a funnel having a deflection yoke on an outer periphery thereof, including:

a body connected to the panel; and a cone connected to the body, the cone having an outer periphery; and a neck, connected to the cone of the funnel, having an electron gun disposed therein, wherein the cone has a deflection power reducing shape formed in such a manner that the outer periphery of a portion of the cone has a predetermined curvature which is contiguous to the body and has a shape of an arc on a range from an end of the cone at the neck to a point on the outer priphery of the cone, where said arc has, a length 0.25×L measured along an axis of symmetry of the cathode ray tube from the end of the cone at the neck, where L is an entire length of the cone from the neck to the body measured along the axis of symmetry of the cathode ray tube.

2. The cathode ray tube as recited in claim 1, wherein the deflection power reducing shape is formed in such a manner that the outer periphery of the cone from the end of the cone at the neck to a length of 0.25×L from the end of the cone at the neck, as viewed in a cross section perpendicular to the axis of symmetry has a shape of an arc with a radius satisfying the following conditions:

$$|Cz|<4.5 \text{ mm}$$

$$25 \text{ mm}<r1<50 \text{ mm}$$

where Cz is a coordinate of a center for the arc in the axis of symmetry direction from the end of the cone at the neck; and r1 is the radius of curvature of the arc.

3. The cathode ray tube as recited in claim 1, wherein the deflection power reducing shape is formed in such a manner that the outer periphery of the cone from the end of the cone at the neck to a length of 0.25×L from the end of the cone at the neck, as viewed in a cross section perpendicular to the axis of symmetry has a curvature satisfying the following condition:

$$0.26<R<0.43$$

where R is an average variation of height for all points on the curvature, measured from the axis of symmetry to each point on the curvature.

* * * * *